73-151
7/24/84 OR SR 4,461,171

United States Patent [19]
de la Cruz

[11] Patent Number: 4,461,171
[45] Date of Patent: Jul. 24, 1984

[54] METHOD AND APPARATUS FOR DETERMINING THE IN SITU DEFORMABILITY OF ROCK MASSES

[75] Inventor: Rodolfo V. de la Cruz, Madison, Wis.

[73] Assignee: Wisconsin Alumni Research Foundation, Madison, Wis.

[21] Appl. No.: 457,716

[22] Filed: Jan. 13, 1983

[51] Int. Cl.[3] ..... E21B 49/00
[52] U.S. Cl. ..... 73/151; 73/783; 73/784
[58] Field of Search ..... 73/784, 783, 151

[56] References Cited

U.S. PATENT DOCUMENTS

| | | | |
|---|---|---|---|
| 2,927,459 | 3/1960 | Farrington . | |
| 2,957,341 | 10/1960 | Menard . | |
| 3,234,788 | 2/1966 | Talobre . | |
| 3,442,123 | 5/1969 | Broise | 73/784 |
| 3,446,062 | 5/1969 | Goodman et al. . | |
| 3,466,926 | 9/1969 | Ruppeneit et al. . | |
| 3,538,755 | 11/1970 | de la Cruz et al. . | |
| 3,858,441 | 1/1975 | Comeau . | |
| 3,896.663 | 7/1975 | Ogura . | |
| 3,961,524 | 6/1976 | de la Cruz . | |
| 3,969,929 | 7/1976 | Shaw et al. . | |
| 4,149,409 | 4/1979 | Serata | 73/151 |

OTHER PUBLICATIONS

R. V. de la Cruz, Modified Borehole Jack Method for Elastic Property Determination in Rocks, Rock Mechanics 10, pp. 221-239 (1978).

*Primary Examiner*—Howard A. Birmiel
*Attorney, Agent, or Firm*—Isaksen, Lathrop, Esch, Hart & Clark

[57] ABSTRACT

Measurements of the deformability of deep rock masses are made by positioning a borehole jack (20) having opposed bearing plates (22, 24) in a borehole at a position at which measurements are to be made, and driving the pressure plates (22, 24) apart to displace the walls of the borehole. A lateral displacement probe (30) is mounted between the pressure plate surfaces in position to detect and measure displacements of the wall of the borehole at points lying on a diameter perpendicular to the direction of the resultant of the equal and opposite forces applied by the pressure plates (22, 24) to the wall (21) of the borehole. The lateral displacement probe (30) includes probe tips (35) that are biased firmly against the wall (21) of the borehole to move inwardly or outwardly therewith. A displacement transducer provides an output signal transmitted to the surface which is indicative of the displacements of the probe tips (35). The measurement of displacement at positions perpendicular to the resultant of the forces applied to the borehole by the pressure plates are more reliably related to the deformability characteristics of the rock mass than measurement of the displacements of the rock mass directly under the pressure plates.

20 Claims, 3 Drawing Figures

METHOD AND APPARATUS FOR DETERMINING THE IN SITU DEFORMABILITY OF ROCK MASSES

TECHNICAL FIELD

This invention pertains generally to the field of techniques and apparatus for measuring characteristics of earth formations and particularly the deformability or elasticity of deep rock formations.

BACKGROUND ART

Information on the in situ deformability of rock masses in the earth is of particular importance in determining the suitability of a site for construction of structures either on the rock or within the rock mass. Knowledge of the deformability of the deep rock masses is necessary to allow proper numerical modeling of the rock structures, to calculate the stresses in the rock from observed strains or deformations, and to properly determine the stresses experienced by a rock mass to enable an assessment of the stability of openings to be formed in the rock.

The underground earth masses are accessed for testing purposes through a hole drilled from the surface—a preexisting hole drilled for other purposes, as for oil and gas exploration, or one drilled specifically for the purpose of allowing measurements to be taken of the deep earth formations. A test device, which may be one of a variety of constructions, is lowered to the selected depth and is operated to apply pressure to the walls of the hole. The resulting deformation of the wall areas under pressure is measured and related to the applied pressure to estimate the deformability of the rock.

Examples of borehole displacement testing devices are the borehole jack devices shown in U.S. Pat. Nos. 3,446,062 and 3,961,524. These devices use pairs of shoes or bearing plates, formed as portions of a cylinder, which move inwardly and outwardly relative to one another. Hydraulic fluid under pressure is provided to pistons which drive the shoes apart against the walls of the borehole, and displacement sensors measure the distance that the shoes are displaced relative to one another after pressure is exerted by the shoes. The shoes may typically displace the rock a few hundredths to a few tenths of an inch under several thousand pounds per square inch of pressure. The displacement of the shoes and the applied pressure provide data that may be used to estimate characteristics of the rock, such as the modulus of elasticity.

In another test method, the CSM cell method, the radial displacements of all points on the borehole wall in response to hydrostatic loading are integrated to determine an aggregate volume change of the borehole. By calculations based on elastic theory, it is possible to calculate the modulus of rigidity of the material surrounding the borehole from a knowledge of the hydrostatic loading and the measured volume change.

The foregoing and other techniques for measuring or estimating the in situ deformability of rock masses generally do not offer reliable and accurate deformability values. Each method produces data, from which the deformability is estimated, which is widely scattered and has large standard deviations. Variations in the estimates of deformability as obtained by the different methods are notable. The primary reason for the discrepancies observed within measurements taken by a single method and between the various methods is the existence of discontinuities in the rock mass. These discontinuities affect the loading conditions, stress distributions, deformations, strains and other parameters used to determine the in situ deformability of the rock. Although such discontinuities can be modeled, and their effect on the in situ deformability can be estimated, the mapping of discontinuities, particularly those at some distance from the borehole, is difficult if not impossible.

As an illustration of the effect of discontinuities in the rock mass, it is observed that fissuring at the borehole wall surface allows the rock surrounding the borehole to be compressed more easily, giving a larger displacement under the applied pressure than would be found if the rock were continuous. In particular, the act of drilling the hole itself may cause disruptions in the borehole surface rock. A borehole jack will primarily compress the rock directly under the curved shoes of the jack, with most of the compressive strain in the rock extending only a short distance into the rock from the shoes. Thus, the surface discontinuities will have a strong influence on the compressibility of the rock as measured by the jack.

The borehole jack method also has other limitations which lead to inaccuracies in the resulting estimates of rock deformability. The semi-circular shoes which press against the walls may not perfectly match the curve of the borehole, resulting in much higher pressures applied at certain localized areas and little or no pressure at other areas. Even for a fairly smoothly bored hole, a shoe which has a 90° cylindrical surface may have only 7° to 17° included angle of contact of its surface with the rock. In many cases the borehole itself may have irregularities or protuberances which are subjected to far higher pressures than the calculated average pressure applied by the shoe to the borehole wall. Depending upon the position at which the measurements of the displacements between the bearing shoes are taken, deformations of the bearing shoes themselves, e.g., a bending or "bowing" of the ends away from the middle, may introduce further errors into the displacement measurements.

SUMMARY OF THE INVENTION

In accordance with the present invention, an estimate of the deformability of deep earth masses is made by applying pressure against opposite sides of a borehole with curved bearing plates and measuring the displacements of the walls of the borehole at points which are on a diameter perpendicular to the resultant direction at which pressure is applied to the borehole. The pressure applied by the bearing plates induces a small but measurable displacements of the wall of the borehole at the perpendicular positions which, it is found, are more reliably related to the structural characteristics of the rock mass than is the relative displacement between the bearing plates themselves. A deformability characteristic, such as the modulus of elasticity of the rock mass, may readily and accurately be calcuated from a knowledge of the displacement of the borehole wall from its intitial position and a knowledge of the pressure applied by the bearing plates.

Obtaining data on the displacements of the borehole under pressure in the manner described above minimizes or eliminates many of the sources of inaccuracies encountered in the conventional borehole displacement techniques. In particular, the uniformity of contact between the surfaces of the bearing plates and the wall becomes relatively unimportant since the strains which account for the displacement of the nonloaded portions of the borehole wall extend much more deeply into the rock mass surrounding the borehole than do the strains which account for the majority of the deflection of the rock mass directly under the bearing plates. Inaccuracies due to surface fissuring and nonuniformity are thereby minimized, and efforts to precisely match the surfaces of the bearing plates with the borehole wall are not necessary. In addition to obtaining more accurate measurements of the elasticity characteristics of the rock, it is possible to correlate the deflection of the walls of the rock away from the bearing plates with the relative displacement of the plates themselves to obtain information concerning the degree of fissuring within the rock and to locate and map discontinuities.

The apparatus of the invention comprises a jack which has a structure which applies pressure to the rock in a manner similar to that shown in U.S. Pat. No. 3,961,524. A pair of metal bearing plates or shoes are mounted for relative movement toward and away from one another, with the surfaces of the bearing plates being curved to approximately match the inner surface of the borehole. Hydraulic pistons mounted within the jack are selectively supplied with hydraulic fluid under pressure to drive the two bearing plates apart, applying pressures in the range of several thousand pounds per square inch to the wall of the borehole. A lateral displacement probe is mounted to the jack at a central position and has a pair of probe pistons which are relatively moveable with respect to one other in a direction which is perpendicular to the direction of relative motion of the bearing plates. The tips of the probe pistons are advanced to contact the borehole wall when the jack is at a desired location and the bearing plates are positioned to begin to exert pressure on the borehole. The probe pistons are biased toward the borehole wall so that their tips will be held tightly against the wall but can move inwardly as the unloaded borehole wall portions are drawn inwardly as a result of the pressure applied by the bearing plates. The displacement of the probe pistons is measured by a displacement transducer such as a linear variable differential transformer. After the displacement measurement is completed, the probe pistons are retracted, and the jack may be withdrawn from the borehole or moved to another location within the hole.

For maximum accuracy, the borehole jack preferably has bearing plates whose length is at least six times the diameter of the borehole, with the lateral displacement probe mounted at a central position in the jack. Under such a condition, where the length of the jack is much greater than the diameter of the borehole, any nonuniform pressure applied at the ends of the jack will have a negligible effect on the stress distribution at the center of the jack where the lateral displacement probe is mounted. Thus, little or no error will be introduced into the measurements as a result of slight bending or bowing of the jack at its ends.

A displacement transducer may optionally be mounted in a conventional position between the two bearing plates of the jack to sense the relative displacement thereof when pressure is applied to the walls of the borehole. By having such information available on the displacement of the bearing plates, as well as the inward displacement of the unloaded portion of the borehole wall, the accuracy and reliability of the data obtained from each of the transducers may be checked. In addition, because the measurement of the displacement of the bearing plates is affected by the degree of fissuring in the borehole wall, whereas the measurement of the perpendicular displacement of the unloaded portion of the borehole wall is not as greatly affected, a comparison of deformability data obtained with the perpendicularly oriented transducers may be used to estimate the amount of fissuring in the rock in which the measurements are taken.

Further objects, features and advantages of the invention will be apparent from the following detailed description taken in conjunction with the accompanying drawings showing a preferred embodiment of apparatus for determining the in situ deformability of rock masses.

BEST MODE FOR CARRYING OUT THE INVENTION

Figure 1:
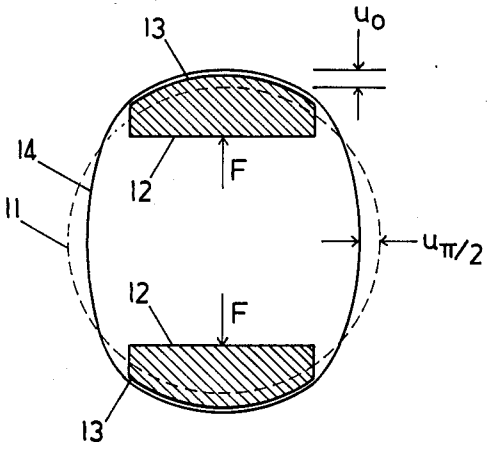
FIG. 1 is a schematic cross-sectional view of bearing plates in a borehole illustrating the deformation of the borehole wall under pressure.

With reference to the drawings, FIG. 1 illustrates the physical principles involved in carrying out the method of determining deformation characteristics of deep earth formations in accordance with the present invention. The method assumes the existence of a substantially circular borehole drilled into the earth formation, either drilled specifically for the purpose of measuring the characteristics of the deep earth formations or drilled originally for other purposes such as oil and gas exploration or various types of geological investigations. The initial, substantially circular borehole is illustrated by the dashed line labeled 11 in FIG. 1. A pair of bearing plates 12 are inserted into the borehole and dropped to a depth in the hole at which testing is desired. Each of the bearing plates 12 has a curved bearing surface 13 which preferably matches the radius of curvature of the initial borehole 11. During the time that the bearing plates 12 are being inserted into the borehole they are drawn toward one another so that sufficient clearance is provided between the bearing plates and the wall of the borehole to allow the bearing plates to be freely dropped into the hole. Upon reaching the desired depth, forces (labeled F in FIG. 1) of equal magnitude and opposite direction are applied to the plates to drive the surfaces 13 of the plates against the wall of the borehole. The resultants of the forces F act in a direction along a diameter of the borehole. The loaded portions of the borehole wall will be pushed outwardly under the pressure applied by the bearing plates. It has been conventional practice to measure the distance between the bearing plates 12 before and after pressure is applied to the borehole wall to determine displacement of the plates, and then correlate the displacement with the applied pressure to estimate the deformation characteristics of the rock mass acted on by the bearing plates. As explained above, the measurements obtained in this manner, while useful, have been notably unreliable as estimators of the deformation characteristics of the tested rock formations.

In the method of the present invention it is recognized that the pressure applied by the bearing plates 12 causes a deflection not only of those portions of the borehole wall that are directly under the bearing plate surfaces 13, but also a deflection of other portions of the borehole wall. A somewhat idealized and exaggerated shape of the borehole wall under pressure applied by the plates 12 is shown by the solid line labeled 14 in FIG. 1. Despite the fact that the bearing plates 12 are acting on the walls of a hole formed in a large—for all practical purposes, boundless—mass, the wall of the borehole surrounding the bearing plates assumes roughly the shape of an ellipse, with the portions of the borehole under pressure being displaced outwardly beyond the normal circular boundary of the borehole and the portions of the borehole which are not under pressure being drawn inwardly from the normal periphery of the borehole. It is observed that the maximum outward displacement of the borehole wall from it normal position occurs at the center of the bearing plate, a distance denoted in FIG. 1 as $U_0$, while the maximum inward displacement of the borehole from its normal position occurs at an angle of 90° to the direction at which the forces F are applied to the two bearing plates 12, a displacement denoted in FIG. 1 as $U_{\pi/2}$. In accordance with the present invention, as explained in further detail below, it is found that the inward displacement, $U_{\pi/2}$, is a more reliable and predictable function of the deformability of the rock mass and the force F applied by the bearing plates 12 than is the direct outward displacement $U_0$. The inward displacement $U_{\pi/2}$ is substantially smaller in magnitude then the outward displacement $U_0$, although still measureable with reasonable precision and repeatability.

Figure 2:
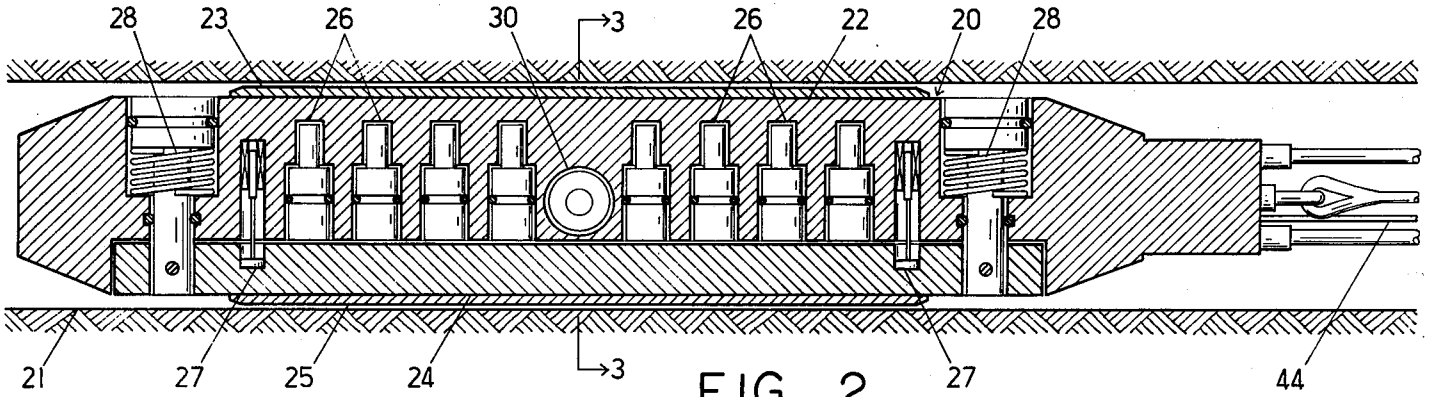
FIG. 2 is a cross-sectional view of a borehole jack device adapted for applying pressure to the wall of a borehole in accordance with the invention.

A borehole jack device 20 in accordance with the present invention is shown in cross-section in FIG. 2 emplaced in a borehole 21, which is shown horizontally rather than vertically for illustrative purposes. The mechanical construction of the jack 20 and the mechanism by which the bearing plates are forced outwardly to deflect the wall of the borehole may be in accordance with the device shown in U.S. Pat. No. 3,961,524, and thus the mechanical details thereof are not shown herein for simplicity. In general configuration, the jack device 20 includes a first or main bearing plate 22 which has a curved bearing surface 23 generally matching the curvature of the borehole, and a second bearing plate 24 which also has a curved bearing surface 25. A series of pistons 26 extend from mounting to the bearing plate 24 and are slidingly received within openings or cylinders formed in the body of the first bearing plate 22. The pistons 26 are shown in FIG. 2 fully inserted into the corresponding cylinders within the first bearing plate 22. Channels (not shown) are formed in the bearing plate 22 to supply hydraulic fluid to each of the cylinders in which the pistons 26 slide. When such hydraulic fluid channels are supplied with hydraulic fluid under pressure, the pistons 26 are forced out of their receiving cylinders and drive the second bearing plate 24 away from the first bearing plate 22, thereby applying pressure to the walls of the borehole 21. The displacement of the two bearing plates 22 and 24 with respect to one another may be measured by displacement transducers 27 mounted at either end of the jack 20, which, for example, may comprise linear variable differential transformers (LVDT) capable of measuring relatively small displacements, 1/10,000 of an inch or less, with reasonably high accuracy. Springs 28 are also preferably provided to bias the bearing plates 22 and 24 toward one another when hydraulic pressure is not applied to the pistons 26. The details of the construction of the springs, the connecting lines by which the hydraulic fluid is supplied to the jack, and so forth, are shown in the aforesaid U.S. Pat. No. 3,961,524.

At the center of the jack 20 is mounted a lateral displacement probe 30 which lies generally along an axis perpendicular to the direction in which force is applied by the bearing plates 22 and 24 to the wall of the borehole. The lateral displacement probe 30 is preferably mounted at the center of the jack 20 because the strain field within the rock surrounding the borehole will be more nearly uniform at the center of the jack than the strain field in the rock at a position closer to the ends of the jack. To insure the substantial uniformity of the strain field at the center of the jack, it is also preferred that the bearing plates 22 and 24 have a length at least six times the diameter of the borehole.

Figure 3:
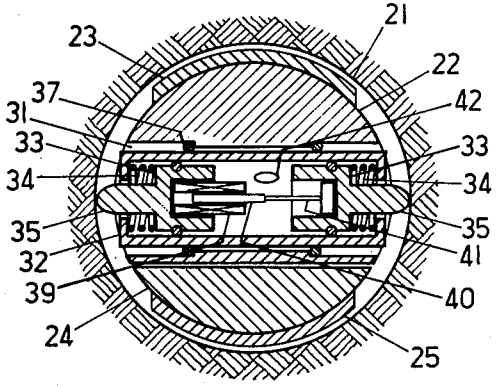
FIG. 3 is a cross-sectional view of the borehole jack taken along the lines 3—3 of FIG. 2.

A cross-section of the jack 20 showing the lateral displacement probe 30 in more detail is provided in FIG. 3. In the embodiment of the displacement probe shown, a cylindrical opening 31 is formed within the body of the first bearing plate 22, with the axis of the cylindrical opening lying perpendicular to the direction in which force is applied to the bearing plates 22 and 24. Within the opening 31 is mounted a cylindrical shell 32 having walls defining a cylindrical channel therein also aligned with its axis perpedicular to the direction in which pressure is applied by the bearing plates. A pair of probe pistons 33 are mounted within the interior channel of the shell 32 and are adapted to move back and forth within the shell 32 in sliding, sealing relation with the interior channel walls of the shell. Springs 34, mounted between end abutments of the shell 32 and the pistons 33, normally urge the pistons inwardly. The shell 32 is held within the opening 31 by flexible rubber or plastic rings 37 which allow limited flexing movement of the shell 32 with respect to the main pressure plate 22. Each of the probe pistons 33 has an outwardly extending probe tip 35 which preferably converges to a rounded point at its end as shown. The probe tips 35 are adapted to engage the wall of the borehole 21 at a small area approaching a "point." The "points" at which the probe tips 35 contact the borehole wall lie on a diameter line which is perpendicular to the diameter along which forces are applied to the bearing plates 22 and 24. Effectively, the bearing plates 22 and 24 apply equal and opposite pressures to the borehole wall, which have equal magnitude and oppositely directed resultant forces each directed along a line lying on a diameter of the borehole, whereas the probe tips 35 engage the wall of the borehole at points which lie on a diameter which is perpendicular to the diameter along which the resultant forces are applied by the bearing plates 22 and 24.

The probe pistons 33 can be biased outwardly against the force of the springs 34 by supplying air under pressure to an opening 42 in the cavity defined between the pistons 33 with the shell 32. The probe tips 35 will then be resiliently pressed against the wall of the borehole 21 and will move inwardly and outwardly as the borehole wall moves. The relative displacements of the two probe pistons 33 is detected by a displacement transducer such as a linear variable differential transformer (LVDT) having a coil 39 fixedly mounted to one of the probe pistons 33 and a core 40 fitting within the coil 39 and attached to a rod 41 which extends to and is attached to the other probe piston. When the coil 39 is properly excited by an electrical signal supplied through wires from the surface (not shown) a signal will be provided on output lines from the coil (also not shown for simplicity) which is indicative of the relative displacement of the two probe pistons 33 since the core 40 will be inserted into the coil 39 a distance which is proportional to the relative displacement of the probe pistons 33. During the insertion and withdrawal of the jack 20 no air under pressure is supplied to the opening 42 and the probe tips 35 are thus maintained away from the walls of the borehole by the force of the compression springs 34. A channel (not shown) within the bearing plate 22 connects to the hole 42 in the shell 32. The channel within the bearing plate 22 communicates with a hose 44 extending to the surface. Thus, an operator at the surface can selectively advance the probe pistons 33 to contact the borehole wall by applying air pressure to the hose 44, and can retract the pistons simply by releasing the air pressure. The pressure applied to the pistons is preferably held approximately constant with the aid of an accummulator (not shown) connected to the hose 44. Other, alternative, means may be used to draw the probe pistons 33 inwardly for insertion and withdrawal of the jack, such as by providing a vacuum draw within the shell 32 to retract the pistons against the force of a spring mounted between the pistons, or by any other suitable means such as a solenoid which draws the two probe pistons 33 together as long as the solenoid is energized.

In the preferred method for use of the jack 20, the jack is first located at a region of the borehole where measurements are desired. Next, hydraulic fluid is supplied to the jack at a sufficient pressure to drive the bearing plates 22 and 24 outwardly to seat against opposite segments of the borehole but without substantially loading the walls of the borehole. This initial pressing of the bearing plates against the wall of the borehole stabilizes the position of the jack. Air pressure is then supplied to the lateral displacement probe 30 to drive the probe tips 35 into contact with the borehole wall. An initial position reading is obtained from the coil 39 of the LDVT which indicates the intitial diameter of the borehole. With the output signal from the coil 39 preferably being monitored continuously, increasing hydraulic pressure is then applied to the jack to load the borehole wall. Hydraulic pressure may be supplied to the jack in increasing increments, with the signal from the coil 39 being recorded at each increment to indicate the measured width of the deformed borehole wall. The difference (or differences, where increments in pressure are used) between the borehole wall width before and after loading may be correlated to the applied pressure to estimate the deformation characteristics of the rock mass. After the measurements are completed, the probe tips 35 and the bearing plates 22 and 24 are retracted, and the jack is ready for more measurements at different orientations or elevations in the borehole or for removal from the hole.

Although not shown, it is apparent that additional lateral displacement probes may be mounted in the jack oriented at different angles in the borehole so as to measure deformations at positions of the borehole wall which are not under pressure and are not perpendicular to the pressure applied by the bearing plates. As illustrated in FIG. 1, these other unloaded areas of the borehole wall will also be deformed, although not as greatly as the areas perpendicular to the applied force.

Significant estimates of the deformability characteristics of the earth formation can be made using the perpendicular displacement data gathered in the manner described above. For example, if it is assumed that each of the bearing plates 22 and 24 apply a uniform pressure to the wall of the borehole, which pressure has a resultant force lying along a diameter of the borehole, and that the pressure applied by each bearing plate extends over an angle equal to $2\beta$, and assuming that the rock mass surrounding the borehole is uniform and continuous, it can be shown using the theory of elasticity that the total inward displacement of the borehole at points on a diameter perpendicular to the diameter at which the resultant force is applied to the borehole can be used to estimate the modulus of elasticity E according to the following equation:

$$E = \frac{2(1+\nu)(1-2\nu)dQ}{\pi U_{\pi/2}}\left[\beta - \sum_{m=1}^{\infty}\frac{\cos m\pi \sin 2m\beta}{m(2m+1)(2m-1)}\right]$$

Where:

d is the diameter of the borehole,

Q is the pressure applied by each bearing plate to the borehole wall, $U_{\pi/2}$ is the total inward displacement of both sides of the borehole wall at points on a diameter perpendicular to the diameter at which the resultant force is applied to the borehole, and $\nu$ is Poisson's ratio.

The only unknown element in the foregoing equation is Poisson's ratio. However, it is well known that Poisson's ratio for most rock masses is relatively constant, typically being in the range of 0.25 to 0.3, while the modulus of elasticity of the various rock masses is much more widely variable. Thus, a Poisson's ratio lying in the foregoing range may be assumed in order to arrive at an estimate of the modulus of elasticity. More precise estimates of Poisson's ratio may be obtained by cutting samples of the rock being tested and measuring the Poisson's ratio of the sample at the surface.

If $\beta=\pi/4$, that is, if the curved surfaces 23 of the pressure plates each cover a 90° arc of the borehole wall, then the equation above simplifies to the following:

$$E = \frac{2(1+\nu)(1-2\nu)dQ}{3U_{\pi/2}}$$

The pressure Q applied to the borehole wall can be determined from the hydraulic fluid pressure supplied to the jack 20 from a pump at the surface. Generally, the hydraulic pressure can be multiplied times the area of the pistons 26 to determine the force applied to the plates, and this force can be divided by the area of each plate to provide the pressure Q.

The theoretical model for the displacements produced in response to stress as described above also predicts that the magnitude of the displacements at the areas of the side wall perpendicular to the positions at which the resultant forces are applied to the borehole wall by the bearing plates will be approximately $\frac{1}{3}$ of the magnitude of the displacements directly under the center of the bearing plates.

However, even if the pressure plates do not apply a uniform pressure distribution to the borehole wall, or if isolated points on the surface of the borehole wall under the pressure plates are subject to particularly high or low localized pressures, the estimate of the rock deformation characteristics utilizing the method of the invention is not substantially affected. This is so because the stresses in the rock at positions away from the loaded surfaces are essentially independent of the pressure distribution and the area of contact of the pressure plates with the wall. See, e.g. De la Cruz, R. V. 1978, "Modified Borehole Jack Method for Elastic Property Determination in Rocks," Rock Mechanics, Vol. 10. Numerical analyses have shown that for bearing plates having a face arc which covers no more than 90° of the total circumference of the borehole wall, the stress distribution in the borehole wall at positions perpendicular to the positions at which the resultant forces are applied by the bearing plates to the wall is essentially independent of the surface area of the bearing plates and is a function only of the total force, F, applied by each bearing plate to the wall. If the bearing plates have an arc which is greater than 90°, the stress at the perpendicular points on the borehole wall becomes, in part, a function of the area of the bearing plate in contact with the wall.

As noted above, cracks or fractures in the borehole wall and in the deeper rock mass contribute to large data scatter and substantial variations in the in situ deformability values obtained by existing methods. This occurs because the rock mass response at the loaded surfaces is primarily a function of the condition of the rock within a small depth of the borehole wall surface. prior studies using plate loading tests show that about 80% of the plate displacement is due to compression of material in the plate within a distance of approximately 4 radii of the loaded wall. Such studies also show that about 80% of the displacements measured outside of the loaded surface were due to materials in the plate within 10 radii of the surface. While such studies are not immediately applicable to the more complex and potentially discontinuous structures within the rock surrounding a borehole, it is apparent that the displacements measured at positions on the borehole perpendicular to the applied forces will be much more influenced by stresses at deeper positions within the surrounding rock than the displacements immediately under the positions where force is applied to the borehole wall.

By providing displacement transducers 27 which lie parallel to the direction in which force is applied to the borehole wall, in addition to the displacement probe 30 which measures displacements perpendicular to the applied force, data will be obtained which can be utilized to estimate the relative degree of fracturing in the borehole wall. Such estimations are possible because displacements under the bearing plates 22 and 24 in fractured areas of the borehole will yield greater displacements between the bearing plates than would be predicted by the displacements observed at the positions on the wall perpendicular to the applied force.

It is understood that the invention is not confined to the particular embodiment herein illustrated and described, but embraces such modified forms thereof as come within the scope of the following claims.

What is claimed is:

1. Apparatus for use in determining the deformability of rock formations surrounding a borehole, comprising:

(a) means for applying unidirectional pressure to opposite segments of the borehole wall, and (b) lateral displacement probe means, associated with the means for applying unidirectional pressure, for measuring the displacement of the wall of the borehole along a diameter which is perpendicular to the direction in which the means for applying unidirectional pressure applies pressure to the borehole wall, and for providing an output signal indicative of such displacement of the borehole wall.

2. The apparatus of claim 1 wherein the means for applying unidirectional pressure includes:

a pair of opposed bearing plates having curved bearing surfaces adapted to match the wall of the borehole, means for mounting the bearing plates to each other for movement toward and away from one another, means for selectively driving the bearing plates away from one another to cause the surfaces of the bearing plates to contact and press against the wall of a borehole in which the apparatus is positioned.

3. The apparatus of claim 1 wherein the lateral displacement probe means includes:

walls associated with the means for applying unidirectional pressure defining a cylindrical channel the axis of which lies perpendicular to the direction of the pressure applied by the means for applying unidirectional pressure, a pair of probe pistons movable within the cylindrical channel and slideably engaging the walls of the cylindrical channel, probe tips extending outwardly from the probe pistons and having converging ends, means for selectively and resiliently biasing the probe pistons outwardly, and displacement transducer means mounted between the probe pistons for measuring the displacement of the probe pistons with respect to one another, whereby the change in position of the probe pistons before and after pressure is applied to the borehole wall may be measured.

4. The apparatus of claim 2 wherein the lateral displacement probe means includes:

a cylindrical opening formed in one of the bearing plates and having an axis lying perpendicular to the direction in which the bearing plates apply pressure to the borehole wall, a shell mounted within the cylindrical channel formed therein with its axis lying perpendicular to the direction in which the bearing plates apply pressure to the borehole wall, a pair of probe pistons movable within the cylindrical channel and slideably engaging the walls of the cylindrical channel, probe tips extending outwardly from the probe pistons and having converging ends, means for selectively and resiliently biasing the probe pistons outwardly, and displacement transducer means mounted between the probe pistons for measuring the displacement of the probe pistons with respect to one another, whereby the change in position of the probe pistons before and after pressure is applied to the borehole wall may be measured.

5. The apparatus of claim 3 wherein the displacement transducer means comprises a linear variable differential transformer having its coil mounted to one of the probe pistons and the core connected to the other of the probe pistons such that, when the coil is properly excited, an output signal is provided which is proportional to the distance between the two probe pistons.

6. The apparatus of claim 4 wherein the displacement transducer means comprises a linear variable differential transformer having its coil mounted to one of the probe pistons and the core connected to the other of the probe pistons such that, when the coil is properly excited, an output signal is provided which is proportional to the distance between the two probe pistons.

7. The apparatus of claim 2 including means for sensing the displacement between the bearing plates in the direction in which pressure is applied by the plates and providing an output signal indicative thereof.

8. The apparatus of claim 2 wherein the lateral displacement probe means is mounted at a position midway between the ends of the bearing plates.

9. The apparatus of claim 8 wherein the length of the bearing plates is at least approximately 6 times the diameter of the borehole to be tested.

10. The apparatus of claim 1 wherein the means for applying unidirectional pressure is adapted to apply pressure to a borehole wall over an arc on the borehole wall of approximately 90° or less.

11. The apparatus of claim 2 wherein the curved surfaces of the bearing plates cover an arc no greater than approximately 90°.

12. A method of determining the deformability of rock masses in situ comprising the steps of:

(a) measuring the width of a circular borehole drilled into the rock mass along a diameter defined by two opposite points on the wall of a borehole;

(b) applying opposed forces having resultants lying on a diameter which is perpendicular to the diameter on which the measurement of the borehole width was made; and (c) measuring the width of the borehole, while such forces are applied, along the same diameter as that along which the initial measurement of the width of the borehole was made.

13. The method of claim 12 including the steps of determining the change in the width of the borehole before the opposed forces were applied and during application of the opposed forces and relating the change in width to the magnitude of the opposed forces to determine the deformability characteristics of the rock mass.

14. A method of determining the deformability of rock masses in situ in a circular borehole drilled into the rock mass comprising the steps of:

(a) positioning a pair of bearing plates having curved surfaces at opposite portions of the wall of a bore hole such that the surfaces of the bearing plates are in position to apply unidirectional pressure to the borehole wall;

(b) measuring the width of the borehole between opposite points on a diameter perpendicular to the direction at which the pressure plates are mounted to apply unidirectional pressure to the borehole;

(c) applying forces of equal magnitude and opposite direction to the bearing plates to drive them against the walls of the borehole; and (d) measuring the width of the borehole along the diameter perpendicular to the direction at which forces are applied to the bearing plates, whereby the difference in the measured diameter before and after pressure is applied may be related to the applied force to calculate the deformation characteristics of the rock mass.

15. The method of claim 14 wherein the surfaces of the curved bearing plates substantially conform to the circular periphery of the borehole and each extend over an arc equal to approximately 90° of the circle defining the borehole periphery.

16. The method of claim 15 including the additional step of calculating the modulus of elasticity for the earth mass surrounding the portion of the borehole at which the changes in width are measured according to the equation:

$$E = \frac{2(1+\nu)(1-2\nu)dQ}{3U_{\pi/2}}$$

Where:

E is the estimated modulus of elasticity, $\nu$ is Poisson's Ratio,

Q is the uniaxial average pressure applied by the bearing plates, d is the initial diameter of the borehole, and $U_{\pi/2}$ is the measured total difference between the width of the borehole at 90° from the direction of applied pressure before and after pressure is applied.

17. The method of claim 14 including, before the other steps, the step of drilling a circular borehole into a subterranean rock mass.

18. Apparatus for use in determining the deformability of rock formations surrounding a borehole, comprising:

(a) means for applying pressure to opposite segments of the borehole wall, and (b) lateral displacement probe means, associated with the means for applying pressure, for measuring the displacement of the wall of the borehole along a diameter at positions of the borehole wall which are not under pressure from the means for applying pressure, and for providing an output signal indicative of such displacement of the borehole wall.

19. The apparatus of claim 18 wherein the means for applying pressure includes:

a pair of opposed bearing plates having curved bearing surfaces adapted to match the wall of the borehole, means for mounting the bearing plates to each other for movement toward and away from one another, means for selectively driving the bearing plates away from one another to cause the surfaces of the bearing plates to contact and press against the wall of a borehole in which the apparatus is positioned.

20. The apparatus of claim 18 wherein the lateral displacement probe means includes:

walls associated with the means for applying pressure defining a cylindrical channel, a pair of probe pistons movable within the cylindrical channel and slideably engaging the walls of the cylindrical channel, probe tips extending outwardly from the probe pistons and having converging ends, means for selectively and resiliently biasing the probe pistons outwardly, and displacement transducer means mounted between the probe pistons for measuring the displacement of the probe pistons with respect to one another, whereby the change in position of the probe pistons before and after pressure is applied to the borehole wall may be measured.

* * * * *